US005483330A

United States Patent [19]

Ogiyama et al.

[11] Patent Number: 5,483,330

[45] Date of Patent: Jan. 9, 1996

[54] IMAGE TRANSFER UNIT OF IMAGE FORMATION APPARATUS

[75] Inventors: Hiromi Ogiyama, Tokyo; Hiroyoshi Haga, Kawaguchi, both of Japan

[73] Assignee: Ricoh Company, Ltd., Tokyo, Japan

[21] Appl. No.: 966,009

[22] Filed: Oct. 23, 1992

[30] Foreign Application Priority Data

| | | | |
|---|---|---|---|
| Oct. 24, 1991 | [JP] | Japan | 3-278054 |
| Nov. 5, 1991 | [JP] | Japan | 3-288812 |
| Jul. 29, 1992 | [JP] | Japan | 4-201677 |

[51] Int. Cl.[6] ..... G03G 15/14

[52] U.S. Cl. ..... 355/277; 355/210; 355/212

[58] Field of Search ..... 355/275, 279, 355/272, 210, 200, 299, 274, 212, 271, 277, 281

[56] References Cited

U.S. PATENT DOCUMENTS

| | | | |
|---|---|---|---|
| 3,866,572 | 2/1975 | Gundlach | 355/275 X |
| 4,165,173 | 8/1979 | Iwai et al. | 355/299 X |
| 4,531,825 | 7/1985 | Miwa et al. | 355/279 |
| 4,607,935 | 8/1986 | Kindt et al. | 355/274 |
| 4,657,373 | 4/1987 | Winthaegen et al. | 355/275 |
| 5,191,378 | 3/1993 | Itaya et al. | 355/277 X |
| 5,318,631 | 6/1994 | Tsukamoto | 355/277 X |

FOREIGN PATENT DOCUMENTS

| | | | |
|---|---|---|---|
| 59-101682 | 6/1984 | Japan | 355/277 |
| 1-112276 | 4/1989 | Japan | 355/299 |
| 4-133080 | 5/1992 | Japan | 355/275 |

*Primary Examiner*—A. T. Grimley
*Assistant Examiner*—Shuk Y. Lee
*Attorney, Agent, or Firm*—Oblon, Spivak, McClelland, Maier & Neustadt

[57] ABSTRACT

An image transfer unit of an image formation apparatus is composed of a belt-shaped image bearing member on which a toner image is to be formed, a plurality of supporting and tension-application rollers which supports and provides tension to the belt-shaped image bearing member, an image transfer roller for transferring the toner image from the belt-shaped image bearing member to a transfer sheet, and a backup member having an outer peripheral elastic layer with a predetermined elasticity. The elastic layer of the backup member is urged with a predetermined pressure toward the image transfer roller via the belt-shaped image bearing member, with the belt-shaped image bearing member being held between the elastic layer of the backup member and the image transfer roller.

5 Claims, 6 Drawing Sheets

IMAGE TRANSFER UNIT OF IMAGE FORMATION APPARATUS

BACKGROUND OF THE INVENTION

1. Field of the Invention

The present invention relates to an image transfer unit of an image formation apparatus such as an electrophotographic copying apparatus or a printer.

2. Discussion of the Background

Conventionally, in an image transfer unit of an image formation apparatus, toner particles deposited on a latent electrostatic image formed on an image bearing member are charged to a predetermined polarity, and an electric field is applied across the image bearing member and an image transfer roller. When a transfer sheet is allowed to pass through a contact portion between the image bearing member and the image transfer roller, the toner image on the image bearing member is transferred to the transfer sheet.

In a conventional image transfer unit of an image formation apparatus employing a belt-shaped photoconductor as an image bearing member, as shown in FIG. 12, a supporting and tension-application roller 1 and a supporting and tension-application roller 2, located in parallel with each other, supports and provides tension to a belt-shaped photoconductor 3, and an image transfer roller 4 which is situated so as to be parallel with the axial direction of the supporting and tension-application rollers 1 and 2 is in contact with the belt-shaped photoconductor 3.

In the above-mentioned image transfer unit, since the belt-shaped photoconductor 3 is made bend by a slight contact with the image transfer roller 4, the friction between the image transfer roller 4 and the belt-shaped photoconductor 3 becomes small, so that image transfer cannot be satisfactorily carried out because of slip of an image transfer sheet 6.

In order to eliminate the above-mentioned inconvenience, for example, Japanese Laid-Open Utility Model Application 60-44060 discloses an image transfer unit in which an image transfer roller is brought into pressure contact with a belt-shaped photoconductor in such a configuration that the belt-shaped photoconductor is made slightly bend along the circumference of one of supporting and tension-application rollers. Owing to such a configuration, the friction between the image transfer roller and the belt-shaped photoconductor can be increased.

The above-mentioned conventional image transfer unit comprising the belt-shaped photoconductor serving as the image bearing member, however, tends to produce an improper image when used with a transfer sheet with a high stiffness such as a sheet of thick paper or a film for use with an OHP. This is because the stiffness of the transfer sheet 6 surpasses the contact force between the belt-shaped photoconductor 3 and the image transfer roller 4, and the belt-shaped photoconductor 3 is therefore partially pressed to produce a gap 11 between the image transfer roller 4 and the transfer sheet 6 or between the image transfer sheet 6 and the belt-shaped photoconductor 3 while the transfer sheet 6 is passing between the belt-shaped photoconductor 3 and the image transfer roller 4. Namely, the transfer sheet 6 is not exactly sandwiched between the image transfer roller 4 and the belt-shaped photoconductor 3, so that the toner image formed on the belt-shaped photoconductor 3 corresponding to the gap 11 is not transferred to the transfer sheet 6.

When the pressure of the image transfer roller 4 applied to the belt-shaped photoconductor 3 is increased not to form the gap 11, there are problems in that the image transfer roller 4 gives the belt-shaped photoconductor 3 a deep thrust, and at the same time, the image transfer roller 4 receives the repulsion force caused by the tension of the belt-shaped photoconductor 3. As a result, the image transfer roller 4 cannot be settled at a definite position.

Moreover, it is difficult to drive a plurality of rollers such as the supporting and tension-application rollers and the image transfer roller to rotate at the same speed by using the respective driving systems or by using an engagement system for transmitting the driving force to the respective rollers. For instance, when a plurality of rollers is driven to rotate by the engagement system such as a series of gears, the number of revolutions of each roller can be adjusted to the desired value but it is difficult to substantially control the moving speed of the surface of each roller to a desired value because of dispersion in the mechanical accuracy with respect to the diameter, and deflection of each roller. In order to allow a plurality of rollers to rotate at the same speed, when these rollers are brought into direct contact with each other to move by dragging, the manufacturing cost of the image transfer unit can be retrenched, and the rollers can be driven to rotate almost at the same speed.

In the relation between the belt-shaped photoconductor 3 and the image transfer roller 4, the resistance is produced by the moment of inertia, and the bearing friction thereof. When this resistance becomes larger than the friction at a contact portion between the belt-shaped photoconductor 3 and the image transfer roller 4, slip occurs therebetween, and dragging of both cannot be achieved properly. In particular, it is important to drive the belt-shaped photoconductor 3 and the image transfer roller 4 to rotate at the same speed in the sense that the toner image on the belt-shaped photoconductor 3 can be accurately transferred to the transfer sheet 6 without the occurrence of enlargement and reduction of the transferred image and slip of the transfer sheet 6.

When a drum-shaped image bearing member is employed in an image transfer unit of an image formation apparatus, the drum-shaped image bearing member comprises a metallic drum, for example, made of aluminum, and a photoconductive material layer formed thereon.

In the conventional image transfer unit comprising the above-mentioned drum-shaped image bearing member, the image transfer roller is also charged in the course of the image transfer operation, and attracting force works between the drum-shaped image bearing member and the image transfer roller. Therefore, this involves the problem that the transfer sheet, after passing through the contact portion between the image bearing member and the image transfer roller, still adheres to the surface of the drum-shaped image bearing member without separating therefrom, since the adhesion between the transfer sheet and the image bearing member surpasses the stiffness of the transfer sheet. When the charge quantity of the transfer sheet is increased, the transfer sheet is thin or has a low stiffness, or the curvature radius of the drum-shaped image bearing member is large, this problem frequently occurs.

In addition to the above, the image transfer roller is conventionally brought into pressure contact with the image bearing member only by use of pressure-application means such as a pressure-application spring. However, the pressure applied by the pressure-application spring varies depending on the kind of pressure-application spring, and the pressure-application spring changes with time, whereby the contacting state of the image transfer roller with the image bearing member easily becomes unstable. Thus, the image transfer operation cannot always be performed under appropriate conditions.

SUMMARY OF THE INVENTION

It is therefore a first object of the present invention to provide an image transfer unit of an image formation apparatus free from the above-mentioned conventional defects, capable of performing excellent image transfer without producing a gap between a transfer sheet and a belt-shaped photoconductor or between the transfer sheet and an image transfer roller by rotating the belt-shaped photoconductor and the image transfer roller at the same speed by dragging.

A second object of the present invention is to provide an image transfer unit of an image formation apparatus also free from the above-mentioned conventional defects, capable of performing excellent image transfer by speedily separating a transfer sheet from an image bearing member after the transfer sheet is caused to pass through a holding portion between the image bearing member and the image transfer roller, with the contacting state of the image transfer roller with respect to the image bearing member being maintained constant.

The first object of the present invention is achieved by an image transfer unit of an image formation apparatus comprising a belt-shaped image bearing member on which a toner image is to be formed, a plurality of supporting and tension-application rollers which supports and provides tension to the belt-shaped image bearing member, and an image transfer roller for transferring the toner image from the belt-shaped image bearing member to a transfer sheet, and a backup member comprising an elastic layer with a predetermined elasticity, which is urged with a predetermined pressure toward the image transfer roller via the belt-shaped image bearing member, with the belt-shaped image bearing member being held between the elastic layer of the backup member and the image transfer roller.

The second object of the present invention is achieved by an image transfer unit of an image formation apparatus comprising an image bearing member on which a toner image is to be formed, and an image transfer member which holds a transfer sheet to which the toner image is to be transferred, between the image bearing member and the image transfer member, the image bearing member having an elastic layer with which the image transfer member is in pressure contact to form an arc-shaped concave portion in the elastic layer of the image bearing member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

The present invention will now be explained in detail with reference to the figures.

Figure 1:
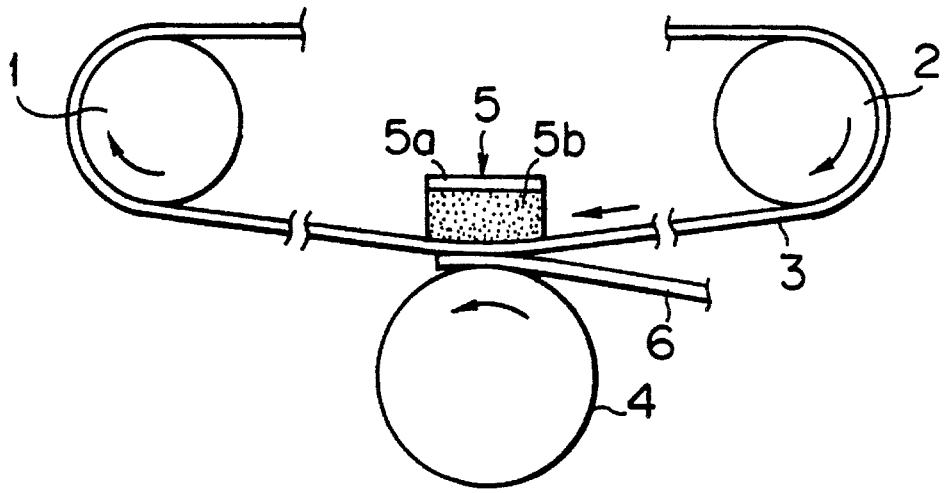
FIG. 1 and 1A are schematic cross-sectional views showing a first embodiment of an image transfer unit according to the present invention.

FIG. 1 shows a first embodiment of an image transfer unit of an image formation apparatus according to the present invention. As shown in FIG. 1, tension-application rollers 1 and 2 support and provide tension to a belt-shaped photoconductor 3, serving as an image bearing member, on which a toner image is to be formed. An image transfer roller 4 for transferring the toner image from the belt-shaped photoconductor 3 to a transfer sheet 6 is situated below the belt-shaped photoconductor 3 and urged with a predetermined pressure toward the belt-shaped photoconductor 3 to come in contact with the belt-shaped photoconductor 3. A backup member 5 is also urged with a predetermined pressure toward the image transfer roller 4 via the belt-shaped photoconductor 3, with the belt-shaped photoconductor 3 being held in a contact portion between the backup member 5 and the image transfer roller 4. Each of the supporting and tension-application rollers 1 and 2, the image transfer roller 4, and the belt-shaped photoconductor 3 is allow to rotate in the direction of the arrow shown in FIG. 1.

The backup member 5 comprises a plate 5*a* made of stainless steel or aluminum, and an elastic layer 5*b* attached to the plate 5*a* which elastic layer 5*b* is for example made of rubber or sponge with a predetermined elasticity.

In the above-mentioned image transfer unit, the elastic layer 5*b* of the backup member 5 is urged with a predetermined pressure toward the image transfer roller 4 via the belt-shaped photoconductor 3, so that the transfer sheet 6 can be led along the belt-shaped photoconductor 3 without producing a gap between the transfer sheet 6 and the belt-shaped photoconductor 3, or between the transfer sheet 6 and the image transfer roller 4 with the position of the image transfer roller 4 maintained.

Figure 1A:
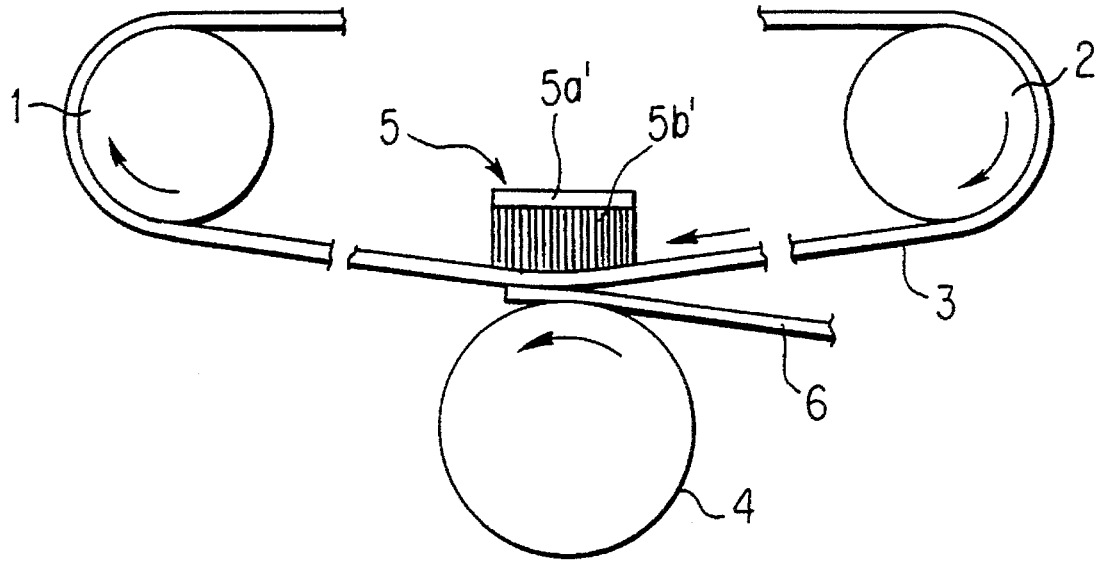

Depending upon the material employed for the elastic layer 5*b* of the backup member 5, the sliding resistance of the backup member 5 may become too large with respect to the belt-shaped photoconductor 3. The above-mentioned sliding resistance can be decreased and the wear of the belt-shaped photoconductor 3 can be decreased, for example by employing a backup member which comprises an aluminum plate 5*a*' and an elastic layer 5*b*' made of nylon brush with short bristles of 1 to 3 mm fixed into the aluminum plate 5*a*' with a density of 25 bristles/cm$^2$(FIG. 1A).

A second embodiment of the present invention will now be explained in detail by referring to FIG. 2.

Figure 2:
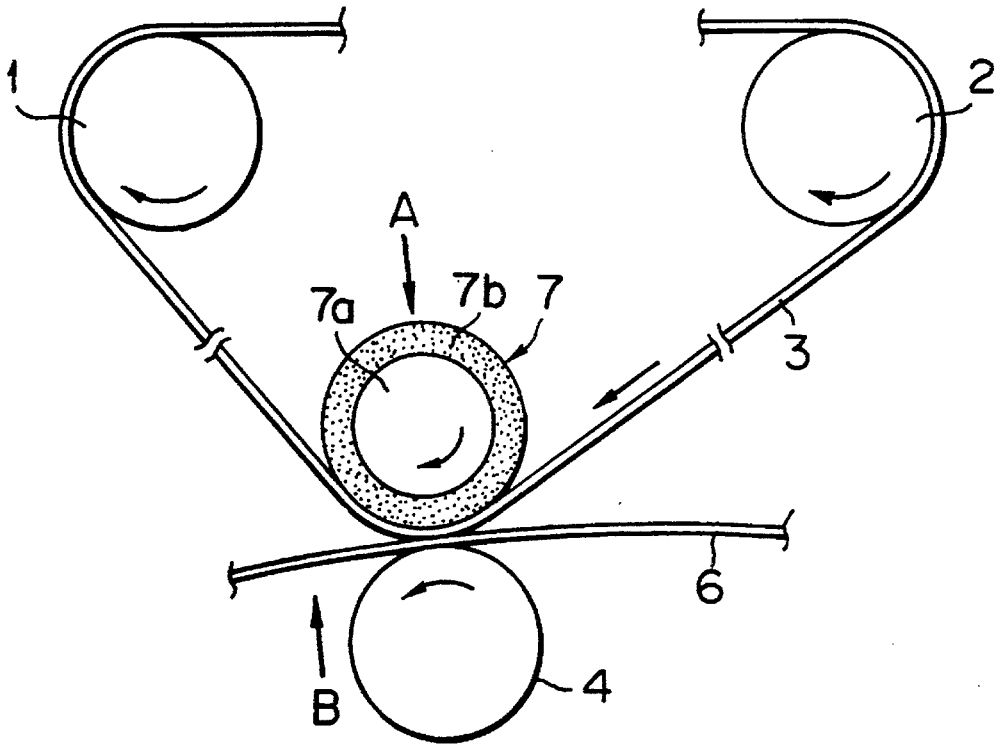
FIG. 2 is a schematic cross-sectional view showing a second embodiment of an image transfer unit according to the present invention.
Figure 3:
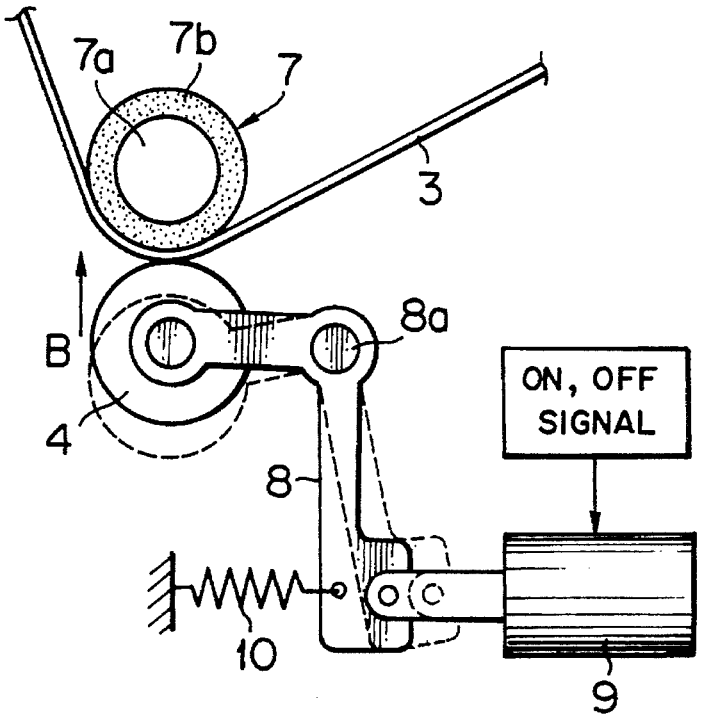
FIG. 3 is a schematic fragmentary cross-sectional view for explaining the structure of image transfer roller detachment and attachment means that may be incorporated in the image transfer unit shown in FIG. 2.

In FIGS. 2 and 3, the same members as those employed in FIG. 1 respectively have the same reference numerals. In FIG. 2, a backup supporting and tension-application roller 7, which is regarded as one of a plurality of supporting and tension-application rollers for a belt-shaped photoconductor 3, is used instead of the backup member 5 employed in FIG. 1. The backup supporting and tension-application roller 7, which is supported by a bearing member (not shown), is urged with a predetermined pressure in the direction of an arrow A to make the belt-shaped photoconductor 3 bend, and the belt-shaped photoconductor 3 is held between the backup supporting and tension-application roller 7 and an image transfer roller 4.

The backup supporting and tension-application roller 7 comprises a core 7*a* made of stainless steal and an outer peripheral elastic layer 7*b* provided on the core 7*a*, which elastic layer is, for example, made of chloroprene rubber with a hardness of 50° (as used herein, the hardness scale is with reference to Japanese Industrial Standards (JIS) K 6301, "Spring Type Hardness Test-Type A", as is known worldwide, and typically described utilizing the symbol "Hs(JIS A)"). The material of the outer peripheral elastic layer 7***b* is not limited to the chloroprene rubber, and other materials such as silicone can be employed. When the hardness of a rubber used for the outer peripheral elastic layer 7*b* is less than 70°, the outer peripheral elastic layer 7*b* with an appropriate elasticity can be obtained. Moreover, the outer peripheral elastic layer 7*b* can be made of an expanded rubber material or a nylon brush as described in the explanation of FIG. 1.

Further, as shown in FIG. 3, the image transfer roller 4 may be supported at one end of an arm 8 which is designed so as to revolve toward the image transfer unit side on a supporting point 8*a*. The other end of the arm 8 is connected to a solenoid 9, and to this end a spring 10 which is fixed to the image transfer unit is attached.

The arm 8, the solenoid 9, and the spring 10 constitute image transfer detachment and attachment means.

In the image transfer unit with the above-mentioned structure, as shown in FIG. 3, the image transfer roller 4 moves in the direction of an arrow B when the "OFF" signal is sent to the solenoid 9 to turn it off when the image transfer process is started. Thus, the belt-shaped photoconductor 3 and the transfer sheet 6 are held between the image transfer roller 4 and the backup supporting and tension-application roller 7 with an appropriate pressure applied thereto (refer to FIG. 2). When the image transfer operation is not carried out, the "ON" signal is sent to the solenoid 9 to turn it on, so that the image transfer roller 4 is detached from the belt-shaped photoconductor 3, as illustrated by the broken line in FIG. 3.

In this case, the belt-shaped photoconductor 3 is made bend along the outer peripheral elastic layer 7*b* of the backup supporting and tension-application roller 7, so that the contact portion of the belt-shaped photoconductor 3 with the image transfer roller 4 is caused to have a predetermined curvature. Accordingly, when the transfer sheet 6 is caused to pass through the contact portion with a curvature, the transfer sheet 6 on which a toner image is printed is led straight through the contact portion, and the belt-shaped photoconductor 3 is readily separated from the transfer sheet 6 along the curved surface. This mechanism prevents the toner image once transferred to the transfer sheet 6 from touching the belt-shaped photoconductor 3, so that retransfer of the toner image can be avoided.

In the above described embodiment, the belt-shaped photoconductor 3 and the transfer sheet 6 is held between the backup supporting and tension-application roller 7 to which pressure is applied in the direction of the arrow A, and the image transfer roller 4 to which pressure is applied in the direction of the arrow B, as well as in FIG. 1.

Therefore, the friction between the belt-shaped photoconductor 3 and the transfer sheet and that between the transfer sheet and the image transfer roller 4 can be increased, and the belt-shaped photoconductor 3, the transfer sheet, and the image transfer roller 4, can be moved at the same speed, so that occurrence of enlargement and reduction of the transferred image can be avoided. In this embodiment, the belt-shaped photoconductor 3 and the image transfer roller 4 are also rotated by dragging, so that the image transfer roller 4 in the image transfer unit with such a structure is not moved under a motive power of a driving motor (not shown).

A third embodiment of the image transfer unit according to the present invention will now be explained by referring to FIG. 4.

Figure 4:
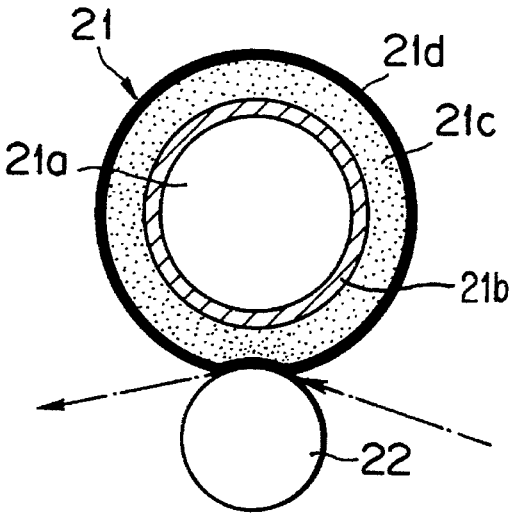
FIG. 4 is a schematic cross-sectional view showing a third embodiment of an image transfer unit according to the present invention.

In FIG. 4, a drum-shaped photoconductor 21 serving as an image bearing member is in pressure contact with an image transfer roller 22. The drum-shaped photoconductor 21 comprise a core 21*a*, a rigid layer 21*b* formed on the core 21*a*, an elastic layer 21*c* on the rigid layer 21*b*, and an electroconductive flexible layer 21*d* formed on the elastic layer 21*c*. The surface of the electroconductive flexible layer 21*d* serves as an image bearing surface.

It is preferable that the elastic layer 21*c* of the drum-shaped photoconductor 21 be softer than the image transfer roller 22 itself or the surface thereof. Specific examples of the material for use in the elastic layer 21*c* are rubber with a hardness of 20° to 60° and sponge with a hardness of 30° or more. In the case where the image transfer roller 22 is made of rubber with a hardness of 60°, for example, a rubber with a hardness of 40° or less is employed as a material for the elastic layer 21*c*.

Moreover, it is preferable that the thickness of the electroconductive flexible layer 21*d* be in the range of 20 to 100 μm. The thickness of the electroconductive flexible layer 21*d* may be determined with the wear resistance and breakage degree thereof taken into consideration.

In the case where the drum-shaped photoconductor 21 on which a latent electrostatic image is to be formed is used as the image bearing member as shown in FIG. 4, a photoconductive layer is provided on the electroconductive flexible layer 21*d*. When an intermediate transfer medium is employed in the image transfer unit, this type of flexible electroconductive layer is not required. In the intermediate image transfer medium, the surface of the elastic layer of the intermediate transfer medium serves as the image bearing surface.

In addition to the above, it is necessary that the image transfer roller 22 be made of a material which is harder than the material of the elastic layer 21*c* of the drum-shaped photoconductor 21, as mentioned previously, although the image transfer roller 22 may be rigid or elastic.

In the image transfer unit with the above-mentioned structure, the image transfer roller 22 is brought into pressure contact with the flexible layer 21*d* of the drum-shaped photoconductor 21 with the predetermined pressure applied to the drum-shaped photoconductor 21 by the image transfer roller 22, and the flexible layer 21*d* and the elastic layer 21*c* are depressed as shown in FIG. 4, whereby an arc-shaped concave portion is formed in the elastic layer 21*c*. The transfer sheet is caused to pass along the arc-shaped concave contact portion. The passage of the transfer sheet is illustrated by the dashed line in FIG. 4, and as apparent from the figure, the transfer sheet is discharged from the contact portion with curved toward the image transfer roller 22. Therefore, the transfer sheet moves in the direction of the arrow in FIG. 4 after termination of the image transfer operation, without adhering to the flexible layer 21*d* of the drum-shaped photoconductor 21.

Figure 5:
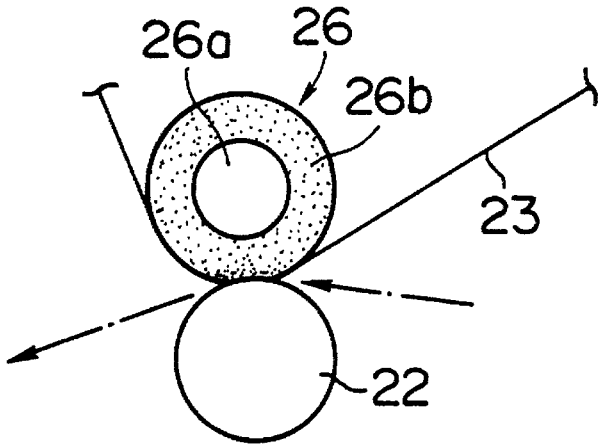
FIG. 5 is a schematic cross-sectional view showing a fourth embodiment of an image transfer unit according to the present invention.

A fourth embodiment will now be explained in detail by referring to FIG. 5. In FIG. 5, a belt-shaped photoconductor 23 is employed as the image bearing member. The belt-shaped photoconductor 23 is supported by a plurality of supporting and tension-application rollers, and a backup supporting and tension-application roller 26. The backup supporting and tension-application roller 26 comprises a core 26*a* and an outer peripheral elastic layer 26*b* formed on the core 26*a*, and the belt-shaped photoconductor 23 is held between the backup supporting and tension-application roller 26 and the image transfer roller 22.

In the image transfer unit with the above structure, the image transfer roller 22 is brought into pressure contact with the outer peripheral elastic layer 26*b* with a predetermined pressure applied to the elastic layer 26*b* by the image transfer roller 22, so that the outer peripheral elastic layer 26*b* is depressed as shown in FIG. 5. Therefore, the contact portion of the belt-shaped photoconductor 23 with the image transfer roller 22 forms an arc-shaped concave. A transfer sheet is thus caused to pass through the arc-shaped contact portion along the dashed line as shown in FIG. 5.

Figure 6:
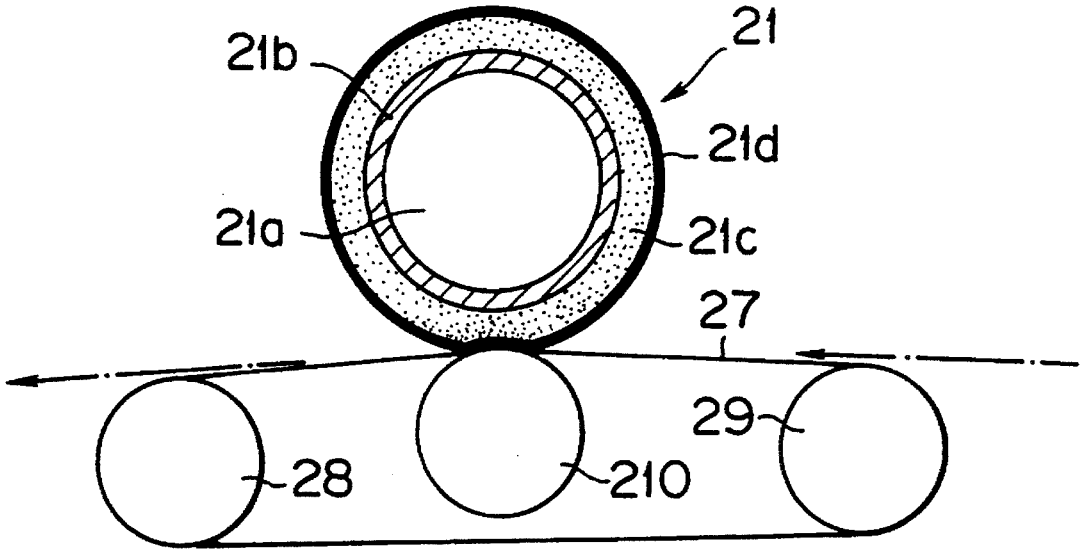
FIG. 6 is a schematic cross-sectional view showing a fifth embodiment of an image transfer unit according to the present invention.

Furthermore, a fifth embodiment will now be explained by referring to FIG. 6. In this embodiment shown in FIG. 6, the same drum-shaped photoconductor 21 as that shown in FIG. 4 is employed, and an image transfer belt 27 is used as the image transfer member instead of the image transfer roller 22 as shown in FIG. 4. Supporting and tension-application rollers 28 and 29 and a backup supporting and tension-application roller 210 support and provide tension to the image transfer belt 27. The backup supporting and tension-application roller 210 is in pressure contact with the drum-shaped photoconductor 21, so that an arc-shaped concave portion is formed in the elastic layer 21*c* of the drum-shaped photoconductor 21. A transfer sheet is caused to pass through the arc-shaped contact portion along the dashed line as illustrated in FIG. 6.

The backup supporting and tension-application roller 210 may be a rotatable roller type or a fixed type. However, the rotatable backup supporting and tension-application roller 210 is preferred in the present invention when a driving torque of the image transfer belt 27, and the wear of the image transfer belt 27 caused by the backup supporting and tension-application roller 210 are taken into consideration.

A sixth embodiment of the present invention will now be explained by referring to FIG. 7 and FIG. 8.

Figure 7:
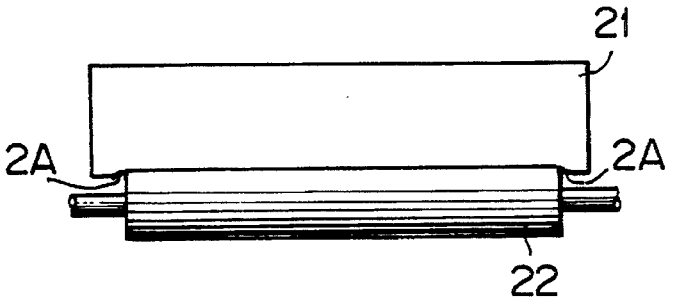
FIG. 7 is a diagram for explaining the contact state of an image transfer roller with a drum-shaped photoconductor for purposes of comparison with the preferred arrangement of FIG. 8.
Figure 8:
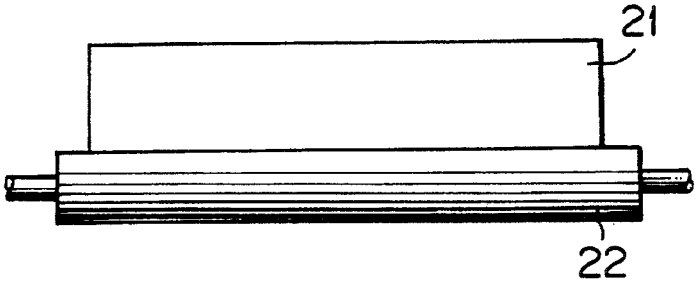
FIG. 8 is a diagram for explaining the contact state of an image transfer roller with a drum-shaped photoconductor in a sixth embodiment of an image transfer unit according to the present invention.

Comparison FIG. 7 shows the drum-shaped photoconductor 21 and the image transfer roller 22 in the image transfer unit viewed from the right angle to the axial direction thereof.

In FIG. 7, the image transfer roller 22 comprises a rigid material or an elastic material harder than the elastic layer 21*c* of the drum-shaped photoconductor 21, so that the image transfer roller 22 is brought into contact with the drum-shaped photoconductor 21 in such a configuration that the image transfer roller 22 is thrust into the drum-shaped photoconductor 21. In the case where the length of the drum-shaped photoconductor 21 in the axial direction is longer than that of the image transfer roller 22 in the axial direction thereof as shown in FIG. 7, the stress is concentrated at both ends 2A of the image transfer roller 22. Accordingly, the image bearing surface of the electroconductive flexible layer 21*d* of the drum-shaped photoconductor 21 may be damaged. As a countermeasure for the above-mentioned problem, the length of the image transfer roller 22 in the axial direction thereof is made longer than that of the drum-shaped photoconductor 21 in the axial direction thereof in the present invention as shown in FIG. 8. Thus, the above-mentioned concentration of stress can be avoided.

The seventh embodiment of the present invention will now be explained by referring to FIG. 9.

Figure 9:
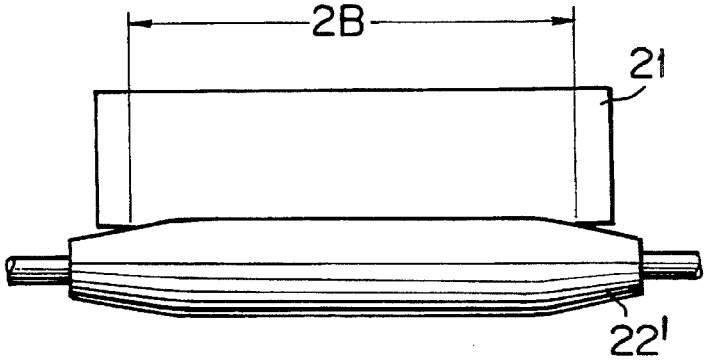
FIG. 9 is a diagram for explaining the contact state of an image transfer roller with a drum-shaped photoconductor in a seventh embodiment of an image transfer unit according to the present invention.

In FIG. 9, the image transfer unit has the same structure as that shown in FIG. 4. In this embodiment shown in FIG. 9, the outer diameter of an image transfer roller 22' decreases towards the opposite ends thereof from internal area thereof with which a drum-shaped photoconductor 21 is in contact and which corresponds to an area within a chargeable region 2B partitioned by broken lines. The image transfer unit with such configuration can prevent the damage of the surface of the drum-shaped photoconductor 21 caused by the concentration of stress.

When the image formation apparatus is designed to perform reversal development using a toner with the same polarity as that of a charged drum-shaped photoconductor 21, toner particles are attached to parts of the photoconductor which are not charged, that is, except the chargeable region 2B. Therefore, this image formation apparatus has the shortcoming that floating toner particles in the image transfer unit which are scattered from an image developing unit or a cleaning unit are attached to the external part of the chargeable region 2B.

On the other hand, in the embodiment shown in FIG. 9, the image transfer roller 22' is in contact with only the chargeable region 2B of the drum-shaped photoconductor 21, so that the toner particles attached to the photoconductor 21 are not transferred to the image transfer roller 22' to stain the same.

An eighth embodiment of the present invention will now be explained by referring to FIG. 10 and FIG. 11.

Figure 10:
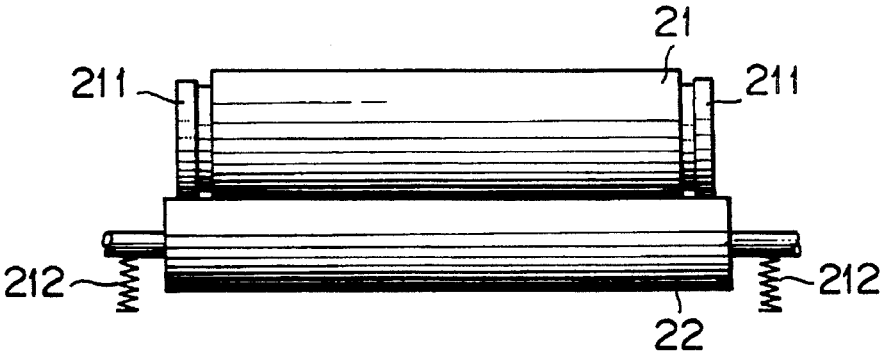
FIG. 10 is a diagram for explaining the contact state of an image transfer roller with a drum-shaped photoconductor in an eighth embodiment of an image transfer unit according to the present invention.
Figure 11:
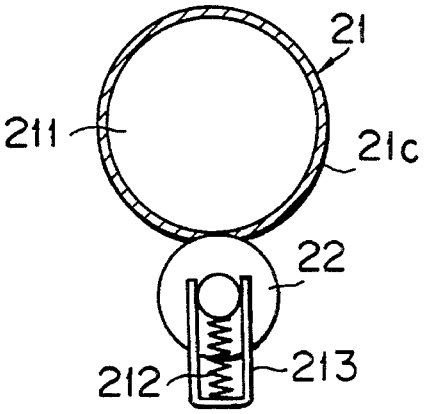
FIG. 11 is a schematic sectional view of the eighth embodiment of the image transfer unit shown in FIG. 10 viewed from the axial direction of the image transfer roller.
Figure 12:
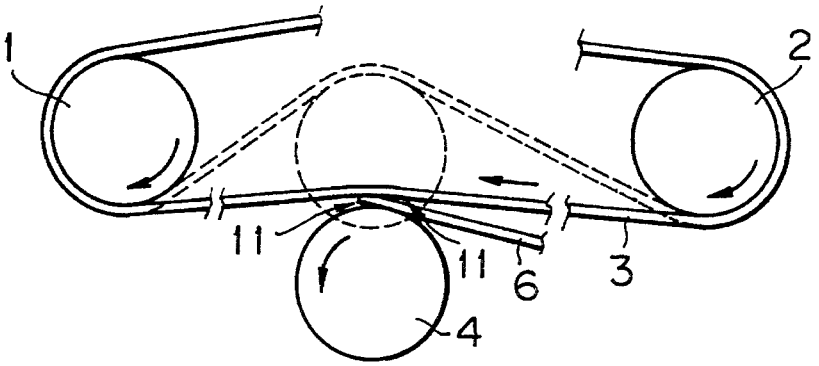
FIG. 12 PRIOR ART
FIG. 12 is a schematic cross-sectional view showing a conventional image transfer unit of an image formation apparatus.

As shown in FIG. 10, the basic structure of the image transfer unit is the same as that shown in FIG. 4. A difference of the image transfer unit show in FIG. 10 from that in FIG. 4 is that a regulation member 211 is disposed coaxially with the drum-shaped photoconductor 21 at each of the opposite ends of the drum-shaped photoconductor 21 for regulating the contact state of the drum-shaped photoconductor 21 with the image transfer roller 22. The outer diameter of the regulation member 211 is slightly smaller than that of the drum-shaped photoconductor 21, and pressure-application springs 212 are attached to the image transfer roller 22 at both ends, with each pressure-application spring 212 contained in a spring case 213 for guiding the movement of the axis of the image transfer roller 22, as is apparent from FIG. 11.

The degree of the pressure applied by pressure-application spring 212 is determined so as to bring the image transfer roller 22 into contact with the regulation member 211. Moreover, it is desirable that the image transfer roller 22 be made of a rigid material in this embodiment. When the image transfer roller 22 is made of an elastic material, however, at least the contact portion of the image transfer roller 22 with the regulation member 211 may be made of a rigid material. With the image transfer unit with the above-mentioned structure, the depth of depression in an elastic layer 21*c* of the drum-shaped photoconductor 21 caused by the image transfer roller 22 can uniformly be regulated by the regulation member 211. As a result, the contact state of the image transfer roller 22 with the drum-shaped photoconductor 21 can be kept constant, thereby maintaining the pressure contact state of the transfer sheet with the drum-shaped photoconductor 21 constant.

As previously explained, in the first embodiment, excellent image transfer can be performed without producing a gap between the transfer sheet and the belt-shaped photoconductor, or between the transfer sheet and the image transfer roller. Moreover, the belt-shaped photoconductor, the image transfer roller, and the transfer sheet can be rotated at the same speed, so that the toner image on the belt-shaped photoconductor can be accurately transferred to the transfer sheet without occurrence of enlargement or reduction of the transferred image and the slip of the transfer sheet.

In the second embodiment, the contact surface portion of the belt-shaped photoconductor with the image transfer roller has a predetermined curvature, so that the transfer sheet is caused to pass through the contact surface portion with a curvature, and the transfer sheet carrying the toner images thereon is readily separated from the belt-shaped photoconductor. This mechanism prevents the toner image once transferred to the transfer sheet from touching the belt-shaped photoconductor, so that retransfer of the toner image can be avoided.

In the third, fourth, and fifth embodiments, the transfer sheet is readily separated from the belt-shaped photoconductor without adhering to the surface of the drum-shaped photoconductor after image transfer. Therefore, excellent image transfer operation can be performed without omission of images and retransfer of the image to the transfer sheet.

In the sixth embodiment, the elastic layer of the drum-shaped photoconductor can be protected from the concentration of stress.

In the seventh embodiment, toner deposition to the image transfer roller can be prevented, and the elastic layer of the drum-shaped photoconductor can be protected from damage because the stress is not concentrated at a portion on the elastic layer of the drum-shaped photoconductor.

In the eighth embodiment, excellent image transfer can be performed with the stable contact state of the image transfer roller with the drum-shaped photoconductor being maintained, as compared with the case where the above-mentioned contact state is controlled by only the pressure-application spring.

What is claimed is:

1. An image transfer unit of an image formation apparatus comprising an image bearing member on which a toner image is to be formed, and an image transfer member which holds a transfer sheet to which said toner image is to be transferred as said transfer sheet is fed between said image bearing member and said image transfer member, said image bearing member having an elastic layer with which said image transfer member is in pressure contact to form an arc-shaped concave portion in said elastic layer of said image bearing member, such that said arc-shaped concave portion is provided in said elastic layer when at least a portion of said transfer sheet is fed between said image bearing member and said image transfer member;

wherein said image bearing member is a drum-shaped photoconductor, and said image transfer member is an image transfer roller, with a length of said image transfer roller in an axial direction thereof being longer than a length of said drum-shaped photoconductor in an axial direction thereof;

said image transfer roller including opposite ends spaced in the axial direction of said image transfer roller, and wherein an outer diameter of said image transfer roller decreases towards the opposite ends thereof from an internal area thereof with which said drum-shaped photoconductor is in contact and which corresponds to an area within a chargeable region of said drum-shaped photoconductor.

2. An image transfer unit of an image formation apparatus comprising an image bearing member on which a toner image is to be formed, and an image transfer member which holds a transfer sheet to which said toner image is to be transferred as said transfer sheet is fed between said image bearing member and said image transfer member, said image bearing member having an elastic layer with which said image transfer member is in pressure contact to form an arc-shaped concave portion in said elastic layer of said image bearing member, such that said arc-shaped concave portion is provided in said elastic layer when at least a portion of said transfer sheet is fed between said image bearing member and said image transfer member;

wherein said image bearing member is a drum-shaped photoconductor, and said image transfer member is an image transfer roller, with a length of said image transfer roller in an axial direction thereof being longer than a length of said drum-shaped photoconductor in an axial direction thereof;

said drum-shaped photoconductor including opposite ends spaced in the axial direction of the drum-shaped photoconductor, the image transfer unit further comprising a regulation member for regulating the contact state of said drum-shaped photoconductor and said image transfer roller, said regulation member being disposed coaxially with said drum-shaped photoconductor at each of the opposite ends of said drum-shaped photoconductor.

3. An image transfer unit comprising an image bearing member upon which a toner image is to be formed, and an image transfer member which holds a transfer sheet to which said toner image is to be transferred as said transfer sheet is fed between said image bearing member and said image transfer member, said image bearing member having an elastic layer with which said image transfer member is in pressure contact to form an arc-shaped concave portion in said elastic layer of said image bearing member, such that said arc-shaped concave portion is provided in said elastic layer when at least a portion of said transfer sheet is fed between said image bearing member and said image transfer member;

wherein an outer diameter of said image transfer roller decreases at opposite ends thereof from an internal area thereof at which said image bearing member is in contact, and wherein said internal area corresponds to an area within a chargeable region of said image bearing member.

4. An image transfer unit comprising an image bearing member upon which a toner image is to be formed, and an image transfer member which holds a transfer sheet to which said toner image is to be transferred, between said image bearing member and said image transfer member, said image bearing member having an elastic layer with which said image transfer member is in pressure contact to form an arc-shaped concave portion in said elastic layer of said image bearing member;

the image transfer unit further including a pair of regulation members for regulating a contact state of said image bearing member and elastic layer with respect to said image transfer member, wherein one regulation member of said pair is disposed at each of a pair of ends of said image bearing member, and wherein said regulation members contact said image transfer member thereby preventing said elastic layer from excessive deformation when said image transfer member is in pressure contact with said image bearing member.

5. An image transfer unit of an image formation apparatus comprising a belt-shaped image bearing member on which a toner image is to be formed, a plurality of supporting and tension-application rollers which are disposed within said belt-shaped image bearing member and which support and provide tension to said belt-shaped image bearing member, an image transfer roller for transferring said toner image from said belt-shaped image bearing member to a transfer sheet, and a backup member disposed within said belt-shaped image bearing member, said backup member comprising a metallic substrate and an elastic layer disposed about said metallic substrate, with an outer surface portion of said elastic layer which comes into contact with said belt-shaped image bearing member comprising a resinous brush with short bristles, which is urged with a predetermined pressure toward said image transfer roller via said belt-shaped image bearing member to form an arc-shaped concave portion in said elastic layer, with said belt-shaped image bearing member being held between said elastic layer of said backup member and said image transfer roller.

* * * * *

UNITED STATES PATENT AND TRADEMARK OFFICE

CERTIFICATE OF CORRECTION

PATENT NO. : 5,483,330

DATED : January 9, 1996

INVENTOR(S) : HIROMI OGIYAMA ET AL

It is certified that error appears in the above-indentified patent and that said Letters Patent is hereby corrected as shown below:

In column 4, line 56, change "allow" to --allowed--.

In column 5, line 31, change "steal" to --steel--.

Signed and Sealed this

Twenty-second Day of October, 1996

*Attest:*

Bruce Lehman

BRUCE LEHMAN

*Attesting Officer*

*Commissioner of Patents and Trademarks*